US010724789B2

(12) United States Patent
Signorino et al.

(10) Patent No.: US 10,724,789 B2
(45) Date of Patent: Jul. 28, 2020

(54) SHELF WITH LIGHTING FUNCTION FOR A DOMESTIC COOLING DEVICE

(71) Applicant: emz-Hanauer GmbH & Co. KGaA, Nabburg (DE)

(72) Inventors: Manfredi Signorino, Wackersdorf (DE); Martin Brabec, Nabburg (DE); Johann Schenkl, Bodenwoehr (DE)

( * ) Notice: Subject to any disclaimer, the term of this patent is extended or adjusted under 35 U.S.C. 154(b) by 0 days.

(21) Appl. No.: 16/372,576

(22) Filed: Apr. 2, 2019

(65) Prior Publication Data

US 2019/0301792 A1 Oct. 3, 2019

(30) Foreign Application Priority Data

Apr. 3, 2018 (DE) ..... 10 2018 002 685

(51) Int. Cl.

| | |
|---|---|
| ***F25D 27/00*** | (2006.01) |
| ***F21V 7/00*** | (2006.01) |
| ***F25D 25/02*** | (2006.01) |
| *F21Y 115/10* | (2016.01) |

(52) U.S. Cl.

CPC ..... *F25D 27/00* (2013.01); *F21V 7/0008* (2013.01); *F25D 25/02* (2013.01); *F21Y 2115/10* (2016.08)

(58) Field of Classification Search

CPC ..... F25D 27/00; F25D 25/02; F21V 7/0008; F21W 2131/305; F21D 27/005

See application file for complete search history.

(56) References Cited

U.S. PATENT DOCUMENTS

| | | | | |
|---|---|---|---|---|
| 6,179,434 | B1 * | 1/2001 | Saraiji | F21V 33/0012 362/125 |
| 6,558,017 | B1 | 5/2003 | Saraiji et al. | |
| 2009/0296383 | A1 | 12/2009 | Valster et al. | |
| 2011/0058353 | A1 | 3/2011 | Yang | |
| 2012/0106129 | A1 * | 5/2012 | Glovatsk | F25D 27/00 362/92 |
| 2014/0376213 | A1 | 12/2014 | Miedema et al. | |
| 2016/0377258 | A1 * | 12/2016 | Xu | F21V 5/04 362/223 |

FOREIGN PATENT DOCUMENTS

| | | | |
|---|---|---|---|
| DE | 102011054761 | A1 | 5/2012 |
| DE | 102015007839 | A1 | 12/2016 |
| WO | 2009/079209 | A1 | 6/2009 |
| WO | 2013/164163 | A1 | 11/2013 |

OTHER PUBLICATIONS

German Patent Office Search Report in German counterpart and priority application No. 10 2018 002 685.0, dated Jun. 21, 2018.

* cited by examiner

*Primary Examiner* — Y M. Quach Lee

(74) *Attorney, Agent, or Firm* — Sarita L. Pickett; Robert Deleault

(57) ABSTRACT

A shelf for a domestic cooling device has a base plate with an edge face, an edge strip extending along the edge face of the base plate where the edge strip has a strip body covering the edge face, and at least one light source element where the strip body forms a light reflection surface which is arranged in a propagation path of the light of the at least one light source element and has a diffuse reflecting effect for at least a portion of the light that is incident thereon.

14 Claims, 3 Drawing Sheets

SHELF WITH LIGHTING FUNCTION FOR A DOMESTIC COOLING DEVICE

BACKGROUND OF THE INVENTION

1. Field of the Invention

The present invention relates generally to a shelf for a domestic cooling device, where the shelf has a lighting function for illuminating an interior of the cooling device serving as a cooling chamber or at least parts of the cooling chamber. The present invention relates further to a domestic cooling device equipped with such a shelf.

2. Description of the Prior Art

Cooling devices for domestic use usually have built-in lighting means which, when the cooling device is open, light the interior in order to give the user a better view of the foods in the cooling chamber. One possibility for illuminating the cooling chamber which has become known in the prior art consists in fitting a strip-like elongate lighting module to a shelf which can be removed from the cooling chamber if required and on which foods can be placed. The lighting module is thereby mounted in the region of an edge face of a base plate of the shelf and extends over at least a portion of the length, optionally even over the entire length, of the edge face. In one configuration which has become known from the prior art, as is disclosed, for example, in DE 10 2015 007 839 A1, at least a portion of the light emitted by the lighting module is coupled into the base plate at the edge face of the base plate, so that the base plate, which is typically made of glass or a transparent plastics material, appears to the observer to be self-illuminating. This makes the foods placed on the shelf easy to see. In another configuration known from the prior art, as is shown, for example, in WO 2013/164163 A1, the lighting module shines its light into the space beneath the shelf, which improves the view of foods that are located in a storage space beneath the shelf.

For the further prior art relating to lighting modules mounted at the edge of a shelf, reference is made, for example, to DE 10 2011 054 761 A1 and to WO 2009/079209 A1.

It is generally perceived to be pleasant by a user if, when he looks into the open cooling chamber, he is not dazzled by brightly shining points of light but instead perceives as uniform a brightness as possible. This is of importance in particular against the background of the increasing miniaturization of light-emitting diodes, which are increasingly being used in domestic appliances for lighting purposes, and the comparatively high radiation intensities which can be generated by light-emitting diodes in a comparatively small solid angle.

SUMMARY OF THE INVENTION

It is an object of the invention to provide a shelf with a lighting function for use in a domestic cooling device, which, while having a high illuminating power, allows a target region to be illuminated as uniformly as possible.

In order to achieve this object, the invention starts from a shelf for a domestic cooling device, comprising a base plate and an edge strip extending along an edge face of the base plate and having a strip body covering the edge face and at least one light source element, in particular of the LED type. According to the invention, the strip body forms a light reflection surface which is arranged in the propagation path of the light of the light source element and has a diffuse reflecting effect for at least a portion of the light that is incident thereon. In this solution, the scattering effect, which is desirable for uniformly bright illumination of the target region, is achieved not by diffuse transmission but by diffuse reflection. There is only a slight, if any, risk of absorption losses at the light reflection surface. The desired scattering effect of the light reflection surface can be achieved, for example, by establishing a suitable defined surface roughness of the light reflection surface. For example, the mean roughness depth Rz (according to DIN EN ISO 4287) in some embodiments is not less than approximately 0.8 μm or not less than approximately 1 μm or not less than approximately 1.6 μm. In some embodiments, the mean roughness depth Rz is not more than approximately 3.5 μm or not more than approximately 3 μm or not more than approximately 2.5 μm. In other embodiments, the mean roughness depth Rz is in a range between approximately 5.5 μm and approximately 15 μm or in a range between approximately 8 μm and approximately 12.5 μm. Alternatively or in addition, the desired scattering effect of the light reflection surface can be achieved by establishing a suitable defined gloss level of the light reflection surface, in particular when the light reflection surface is formed by a painted or coated (e.g. anodised, chromium-plated or powder-coated) reflector body. In some embodiments, the light reflection surface has a gloss level (according to DIN 67 530/ISO 2813) at a measuring angle of 60° of at most approximately 70 GE or at most approximately 60 GE or at most approximately 50 GE or at most approximately 40 GE or at most approximately 30 GE or at most approximately 20 GE or at most approximately 10 GE (corresponding to a semi-gloss, satin-matt, matt or even dull matt appearance of the light reflection surface).

The term base plate is here to be interpreted broadly. It is to include not only solid material plates but also a lattice- or grid-like form, as is sometimes found, for example, in the case of shelves designed especially for the stable storage of bottles.

In some embodiments, when one of the main faces of the base plate is seen in a plan view, the light reflection surface and, if desired, also the light source element are arranged at least in part and in particular even wholly outside the contour of the main face. When the edge face of the base plate is seen in a plan view, the light source element is in some embodiments arranged at least in part inside the contour of the edge face.

In some embodiments, a main beam axis of the light source element is directed away from the edge face of the base plate, in particular at a right angle to the strip longitudinal direction of the edge strip when one of the main faces of the base plate is seen in a plan view (designated E in FIG. 1). In addition, the main beam axis extends at an acute angle to the plate plane of the base plate. When the shelf is in the fitted situation, that is to say when the shelf is inserted into the domestic cooling device with its base plate oriented horizontally, the main beam axis of the light source element in some embodiments extends downwards relative to the plate plane of the base plate at an acute angle of, for example, between approximately 20° and 60° or between approximately 25° and 50°, in order to ensure that a target region situated beneath the shelf in the fitted situation is illuminated.

In some embodiments, at least a portion of the strip body that is arranged between the edge face of the base plate and the light source element, in particular the entire strip body, is made of a non-transparent material. In these embodiments, the edge face of the base plate is shielded by the strip body against the incoupling of light of the light source element. Instead, in these embodiments, the light of the light source element is directed substantially completely above or/and beneath the base plate (in the horizontal fitted position).

In some embodiments, at least a portion of the strip body that forms the light reflection surface, in particular the entire strip body, is formed by a plastics component, for example a white plastics component, which can be produced, for example, by an injection-moulding process or an extrusion process. Alternatively, a portion of the strip body that forms the light reflection surface, in particular the entire strip body, can be formed by an extruded profile component of a metal material, for example aluminium, which in some embodiments has a coat of paint or a coating produced by other techniques (e.g. anodisation, chromium-plating) on its surface.

A lens element having a collecting function can be arranged in the propagation path of the light of the light source element in front of the light reflection surface. The lens element can in particular effect at least approximate collimation of a light beam emitted by the light source element. The provision of the lens element allows the light reflection surface to be formed with a comparatively small surface area, the scattering properties of the light reflection surface nevertheless allowing a comparatively large target region to be illuminated.

In some embodiments, the lens element is part of a hollow extruded body which is separate from the strip body and is made of a transparent material, into the cavity of which the light source element is inserted. The extruded body possesses an outer surface which is closed in cross-section on all sides and thus ensures that the light source element is well encapsulated against the corrosive influence of any moisture which may be present in the cooling chamber of the cooling device. In some embodiments, the edge strip comprises a plurality of light source elements mounted one behind the other in the strip longitudinal direction on a common circuit board, the circuit board being inserted into the cavity of the extruded body.

In some embodiments, the light reflection surface, when viewed in a section perpendicular to the strip longitudinal direction, is curved in an arcuate manner. In this sectional view, it extends from a region within the height of the base plate to a point at a distance from and beneath the base plate, and at the same time is arranged laterally outside the base plate but facing towards the base plate. This makes it possible to arrange the light reflection surface in such a manner that it is concealed from view to an observer looking at the edge strip head on, and at the same time to direct all the light provided by the light source element into the region beneath the base plate.

According to a further aspect, the invention provides a domestic cooling device having a cooling chamber, which can be closed by a door, and a shelf of the type described hereinbefore. The shelf is inserted into the cooling chamber with the base plate oriented horizontally, wherein in some embodiments it is removably inserted, that is to say can be removed from the cooling chamber again. The edge strip is arranged on a front edge face of the base plate that is close to the door, wherein the light reflection surface directs light of the light source element that is incident thereon into a region of the cooling chamber beneath the shelf.

The invention will be explained in greater detail hereinbelow with reference to the accompanying drawings.

DETAILED DESCRIPTION OF THE INVENTION

Figure 1:
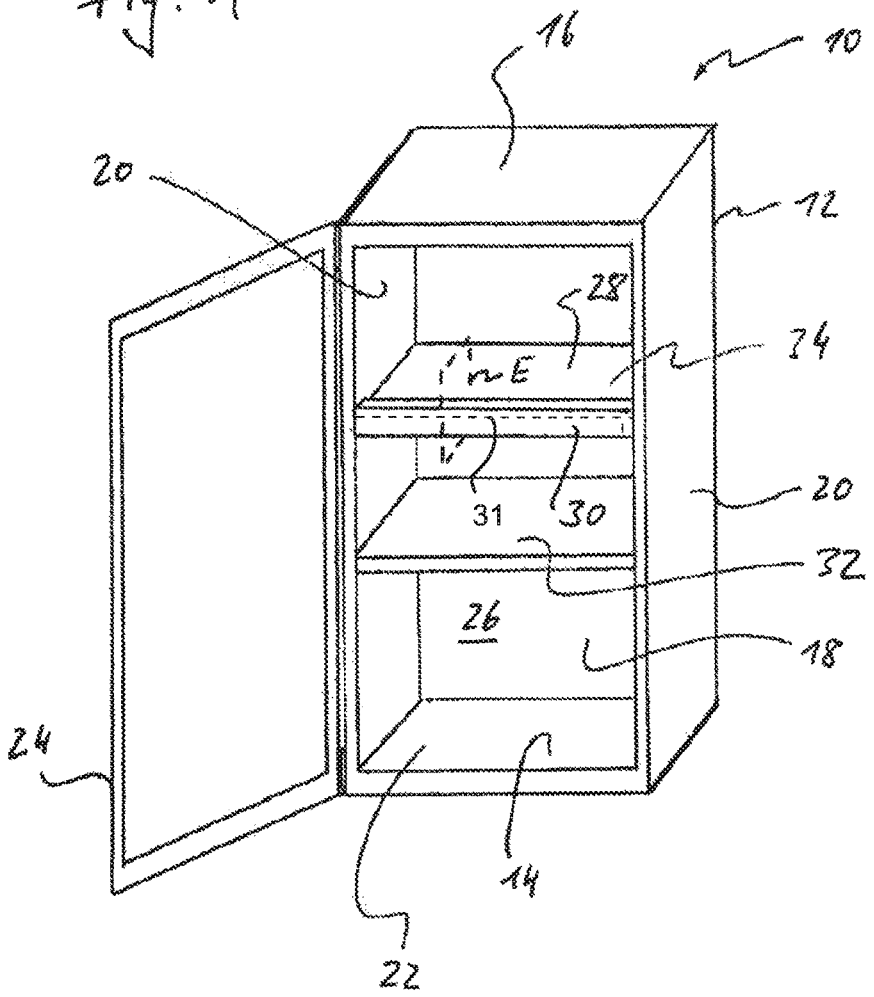
FIG. 1 shows, schematically, a domestic refrigerator according to a first exemplary embodiment.

Reference will first be made to FIG. 1. The device shown therein is designated generally 10. It is a cooling device of the cabinet type, which serves to store foods cold and, if required, can additionally have a freezer compartment which either is arranged inside the cooling chamber of the refrigerator 10 and can be closed relative to the cooling chamber by a flap or—as in the case of top-freezer or bottom-freezer refrigerators—is situated above or below the cooling chamber. It should be added that the expression cooling device within the context of the present disclosure is to be interpreted broadly and is also to include devices which serve solely to store foods in the frozen state (i.e. freezer).

The refrigerator 10 has a cabinet body 12 having a bottom wall 14, a top wall 16, a rear wall 18 and two side walls 20. The cabinet body 12 forms an access opening 22 bordered by the bottom wall 14, the top wall 16 and the two side walls 20, which access opening can be closed by a cabinet door 24 which is articulated with one of the side walls 20 so as to be pivotable about a vertical pivot axis and through which an interior (cooling chamber) 26 of the refrigerator 10 is accessible to the user. The cooling chamber 26 of the refrigerator 10 can be fitted with a wide variety of built-in parts which are suitable for holding and containing foods. At least one of these built-in parts is a shelf 28, on the front, that is to say facing the user, edge face of which there is arranged an edge strip 30, which in the example shown extends substantially over the entire width of the shelf 28 (that is to say from one of the side walls 20 to the opposite side wall 20). The edge strip 30 has an illuminating function for the region of the cooling chamber 26 that is situated beneath the shelf 28, in particular for a region in which there is a ledge 32 which, like the shelf 28, serves to hold foods. The ledge 32 can have the same form as the shelf 28 or a different form. In particular, the ledge 32 can be configured with or without its own lighting function. Regardless of whether the ledge 32 is or is not equipped with its own lighting device for illuminating the space beneath the ledge 32, objects which have been placed on the ledge 32 are illuminated by means of the lighting means integrated into the edge strip 30 of the shelf 28 (which lighting means will be described in greater detail hereinbelow) and are thus readily visible to the user.

Figure 2:
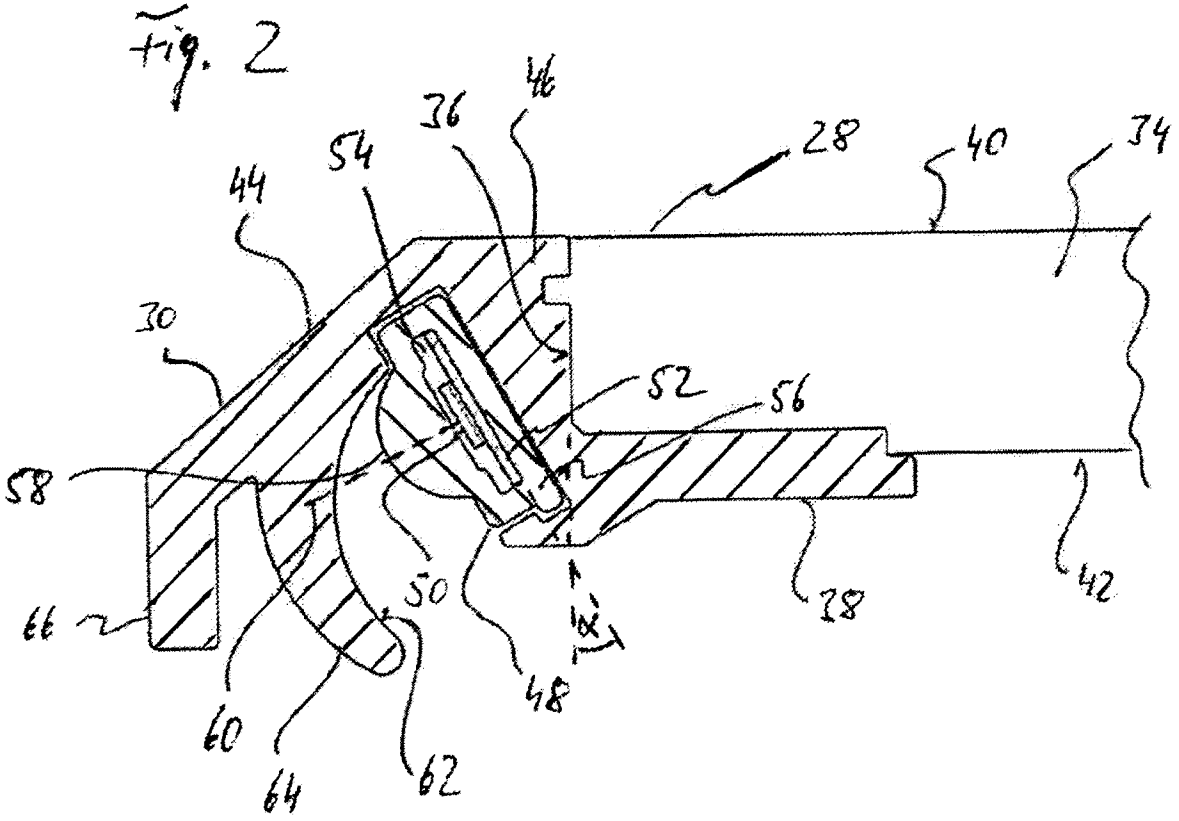
FIG. 2 is a sectional view of a front edge strip of a shelf of the refrigerator of FIG. 1.
Figure 3:
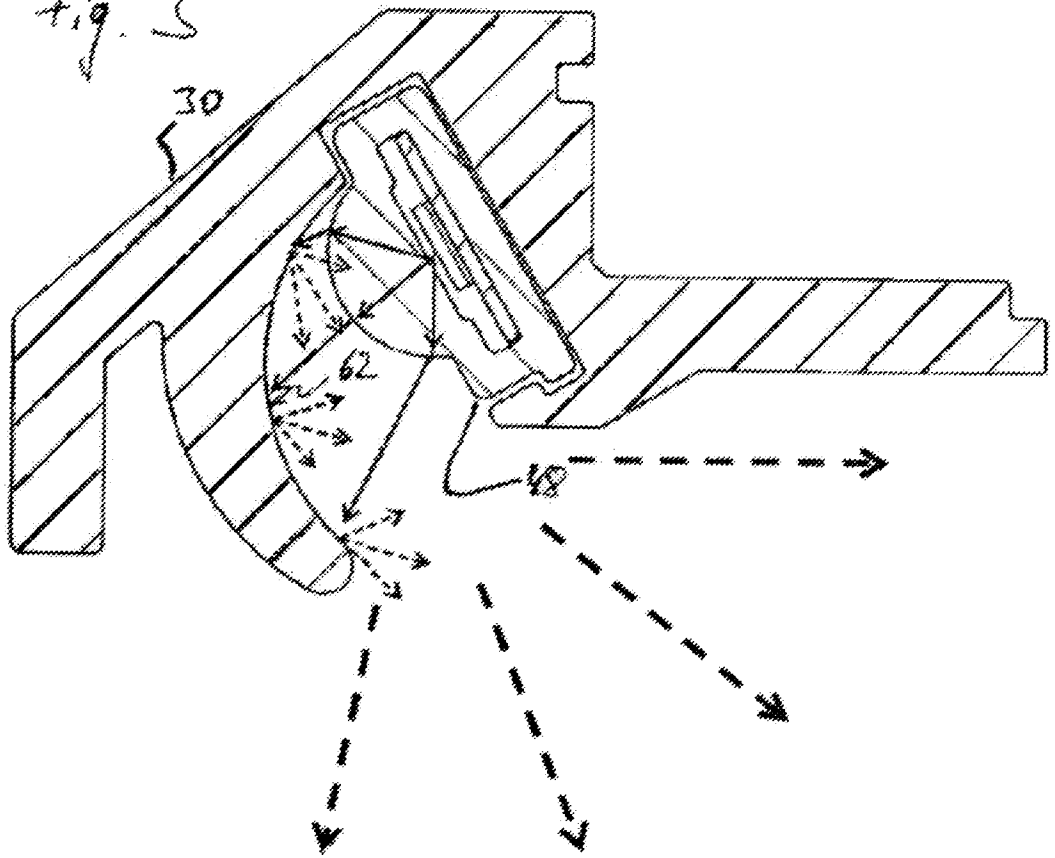
FIG. 3 shows, schematically, the path of light rays in the case of the edge strip of FIG. 2.

The edge strip 30 contains a plurality of light sources arranged at a distance one behind the other in the strip longitudinal direction (designated 31, corresponding to a direction from one of the side walls 20 to the opposite side wall 20, shown in FIG. 1, and not visible in FIGS. 2 and 3, as it would be extending upwards out of the page), which light sources are light-emitting diodes (LEDs) in the example shown in FIGS. 2 and 3. In addition to its lighting function, the edge strip 30 protects the edge of the shelf 28 by covering the front (close to the door) edge or narrow side of a base plate 34 forming the support surface of the shelf 28 and thereby protecting it against mechanical damage. The base plate 34 can—as is usual for shelves for domestic refrigerators—be made of glass or a transparent plastics material.

For a more detailed description of the edge strip 30, reference will now additionally be made to FIGS. 2 and 3. In these figures, the edge strip is shown in a sectional view; a corresponding sectional plane is indicated by a broken line in FIG. 1 and designated E. It will be seen that the edge strip 30 covers the relevant edge face (designated 36) of the base plate 34 over the entire plate height and engages beneath the base plate 34 with a leg 38. The base plate has an upper main face 40 and a lower main face 42 and—assuming that the contour of the base plate 34 is substantially quadrangular when one of the main faces 40, 42 is seen in a plan view—an edge face on each side of the quadrangle. The edge face 36 is the edge face that is at the front when the shelf 28 is in the fitted situation, that is to say the edge face that is closest to the user when he is standing in front of the open refrigerator. The terms top and bottom also relate to the fitted situation in which the shelf 28 is inserted into the interior 26 of the refrigerator 20 with the base plate 34 oriented horizontally.

The edge strip 30 has a strip body 44 which forms the strip leg 38 and comprises a portion 46 located directly in front of the edge face 36. The strip body 44 is made of a non-transparent material. Because it is not transparent, the strip body 44 shields the edge face 36 against the penetration of light. For example, the strip body 44 is made of a white plastics material and extruded or injection moulded.

A lighting assembly 48 is held on the strip body 44, which lighting assembly contains a plurality of light source elements 50 in the form of light-emitting diodes which are arranged one behind the other in the strip longitudinal direction of the edge strip 30. The light-emitting diodes 50 are mounted on a circuit board 52, which is inserted into a cavity 54 of an elongate extruded body 56. The extruded body is a hollow body which can be produced, for example, by extrusion or alternatively by injection moulding. It forms an outer surface which is closed on all sides in the sectional representation of FIG. 2 and is made of a transparent plastics material. In the extruded body 56, the circuit board 52 with the light-emitting diodes 50 mounted thereon is well protected against any corrosive influences of the external environment.

The extruded body 56 forms a collecting lens 58 which effects a reduction in divergence, in particular a parallelisation, of the light beam emitted by a particular one of the light-emitting diodes 50. The collecting lens 58 is in the form of a rod lens, for example.

The circuit board 52 is inclined at an angle $\alpha$ relative to the edge face 36, or relative to the vertical (in the fitted situation), wherein the angle $\alpha$ can have a value, for example, in a range between 20° and 50°. The light-emitting diodes 50 are arranged on the front side of the circuit board 52 remote from the edge face 36 and emit light in the direction obliquely downwards and forwards (forwards meaning the direction towards a user standing in front of the open refrigerator 10). A main beam axis of the light-emitting diodes 50 is shown by a broken line at 60 in FIG. 2. The main beam axis 60 means the axis on which the emission pattern of the light-emitting diodes 50 has the greatest intensity. Assuming that the light-emitting diodes 50 are mounted on the circuit board 52 in such a manner that the main beam axis 60 extends perpendicularly to the board plane of the circuit board 52, the main beam axis 60 is inclined at the angle $\alpha$ to the horizontal plane. In any case, in the exemplary embodiment shown, the light-emitting diodes 50 are so oriented that all the light of the light-emitting diodes 50 is directed into the region beneath the shelf 28. Portions of the light of the light-emitting diodes 50 are not intended to be coupled into the base plate 34 at the edge face 36.

In order that the light emitted obliquely forwards and downwards and collected by the collecting lens 58 passes into the space beneath the shelf 28, the strip body 44 has a light reflection surface 62 which is designed with sufficient surface roughness or/and a sufficiently low gloss level to effect diffuse reflection of the light of the light-emitting diodes 50 that is incident thereon. In the example shown in the sectional representation of FIG. 2, the light reflection surface 62 is curved in an arcuate manner and so arranged relative to the lighting assembly 48 that it is able to illuminate the space beneath the shelf 28 in a comparatively large angle range (seen in the sectional representation in FIG. 2). Suitable contouring of the light reflection surface 62 has the result that certain light portions can travel approximately parallel to the base plate 34 and beneath it towards the rear wall 18 of the body 12 of the refrigerator 10 and other light portions can travel substantially vertically downwards or even with a slight forwards orientation and the entire angle range therebetween is likewise illuminated, as is indicated in FIG. 3 by means of the different broken arrows (which illustrate light rays after scattering at the light reflection surface 62; the solid arrows in FIG. 3, on the other hand, illustrate light rays before they strike the light reflection surface 62).

In the example shown, the light reflection surface 62—when viewed in a sectional plane orthogonal to the longitudinal extent of the edge strip 30, that is to say in the sectional plane of FIGS. 2 and 3—has an asymmetrical profile in respect of the main beam axis 60. In particular, the distance of the light reflection surface 62 from the origin of the main beam axis 60 situated at the light-emitting diode 50 in question increases continuously from one end of the beam angle range of the light-emitting diode 50 across the main beam axis 60 to the other end of the beam angle range. The greatest distance is found at the end of the beam angle range of the light-emitting diode 50 that is closer to the space beneath the base plate 34. The smallest distance is found at the end that is further away from the space beneath the base plate 34. The collecting lens 58, on the other hand, can have a lens effect which is substantially symmetrical relative to the main beam axis 60 in the sectional plane of FIGS. 2 and 3. Substantially all the light emitted by the light-emitting diodes 50 and collected by the collecting lens 58 strikes the light reflection surface 62 directly, that is to say none, or at most only a negligible portion, of the light that leaves the collecting lens 58 passes the light reflection surface 62 directly. This avoids undesirable hotspots, that is to say places of markedly increased brightness on a surface that is irradiated by the light and visible to the user.

For the desired scattering effect, the light reflection surface 62 has, for example, a mean roughness depth Rz of at least 0.8 μm or/and a gloss level of not more than 50% (i.e. semi-gloss to dull matt).

The light reflection surface 62 is formed on a finger-like portion 64 of the strip body 44, which portion shields the lighting assembly 48 visually from view to the user standing in front of the refrigerator 10. The finger portion 64 projects beyond the lighting assembly 48 in the vertically downwards direction, so that the lighting assembly 48 is not visible, or at most is visible in only small portions, to the user when he is standing normally in front of the refrigerator with the door 24 open. In the example shown, a further portion 66 of the strip body 44 is arranged in front of the finger portion 64, which further portion defines the front side of the strip body 44 which is primarily visible to the user and, in terms of its shape, can be configured substantially purely from the aesthetic point of view. The strip portion 66 forms a kind of protecting wall for the finger portion 64 located behind it from the point of view of the observer and protects the finger portion 64 from mechanical damage if the user accidentally strikes the edge strip 30 with his hand or with an object which he is holding in his hand.

It can clearly be seen in FIG. 2 that both the light reflection surface 62 and the light-emitting diodes 50 are located in front of the edge face 36 when viewed horizontally and are consequently outside the contour of the base plate 34 when one of the main faces 40, 42 of the base plate 34 is seen in a plan view. At the same time, the light-emitting diodes 50 are arranged at a vertical height at which they are still located at least in part within the thickness of the base plate 34, that is to say inside the contour of the edge face 36, when the edge face is seen in a plan view.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A shelf for a domestic cooling device comprising:

a base plate having main faces and an edge face;

an edge strip mounted at, and extending along, the edge face of the base plate, the edge strip having a strip longitudinal direction and including a strip body and a lighting assembly held on the strip body, the strip body covering the edge face;

wherein the lighting assembly includes an elongate hollow body, a circuit board and a plurality of light source element mounted on the circuit board;

wherein the hollow body is separate from the strip body and is made of a transparent material;

wherein the hollow body has an outer surface which is closed on all sides when viewed in a section orthogonal to the strip longitudinal direction;

wherein the hollow body has a cavity, and the circuit board is inserted into the cavity;

wherein the strip body forms a light reflection surface which is arranged in the propagation path of the light of the plurality of light source elements and has a diffuse reflecting effect for at least a portion of the light that is incident thereon;

wherein a lens element having a collecting function is formed by the hollow body, the lens element being provided in the propagation path of the light of the plurality of light source elements in front of the light reflection surface;

wherein, when one of the main faces of the base plate is seen in a plan view, the light reflection surface and the circuit board are arranged at least in part outside the contour of the main face; and wherein, when the edge face of the base plate is seen in a plan view, the circuit board is arranged at least in part inside the contour of the edge face.

2. The shelf according to claim 1, wherein, when the one of the main faces of the base plate is seen in a plan view, the light reflection surface and the plurality of light source elements are arranged wholly outside the contour of the one of the main faces.

3. The shelf of claim 1, wherein the hollow body is an extruded or injection-molded body.

4. The shelf of claim 1, wherein the plurality of light source elements are LEDs.

5. The shelf according to claim 1, wherein a main beam axis of each of the plurality of light source elements is directed away from the edge face of the base plate when one of the main faces of the base plate is seen in a plan view, and extends at an acute angle to the plate plane of the base plate.

6. The shelf according to claim 5, wherein the main beam axis is directed away from the edge face at a right angle to the strip longitudinal direction of the edge strip.

7. The shelf according to claim 1, wherein the strip body is made of a non-transparent material.

8. The shelf according to claim 1, wherein the strip body is formed by a white plastic component.

9. The shelf according to claim 8, wherein the white plastic component is mold-injected.

10. The shelf according to claim 1, wherein the lens element collimates a light beam emitted by each of the plurality of light source elements.

11. The shelf according to claim 1, wherein the plurality of light source elements are arranged one behind the other in the strip longitudinal direction on the circuit board.

12. The shelf according to claim 1, wherein, when viewed in a section perpendicular to the strip longitudinal direction, the light reflection surface is curved in an arcuate manner.

13. A domestic cooling device comprising:

a cooling chamber, which can be closed by a door; and a shelf having a base plate with a front edge face, an edge strip being mounted at, and extending along, the front edge face of the base plate, the edge strip having a strip longitudinal direction and including a strip body and a lighting assembly held on the strip body, the strip body covering the front edge face;

wherein the lighting assembly includes an elongate hollow body, a circuit board and a plurality of light source elements mounted on the circuit board;

wherein the hollow body is separate from the strip body and is made of a transparent material;

wherein the hollow body has an outer surface which is closed on all sides when viewed in a section orthogonal to the strip longitudinal direction;

wherein the hollow body has a cavity, and the circuit board is inserted into the cavity;

wherein the strip body forms a light reflection surface which is arranged in the propagation path of the light of the plurality of light source elements and has a diffuse reflecting effect for at least a portion of the light that is incident thereon;

wherein a lens element having a collecting function is formed by the hollow body, the lens element being provided in the propagation path of the light of the plurality of light source elements in front of the light reflection surface;

wherein, when one of the main faces of the base plate is seen in a plan view, the light reflection surface and the circuit board are arranged at least in part outside the contour of the main face;

wherein, when the front edge face of the base plate is seen in a plan view, the circuit board is arranged at least in part inside the contour of the front edge face; and wherein the shelf is removably inserted into the cooling chamber with the base plate oriented horizontally and the front edge face of the base plate being close to the door, wherein the light reflection surface directs light of the plurality of light source elements that is incident thereon into a region of the cooling chamber beneath the shelf.

14. A shelf for a domestic cooling device comprising:

a base plate having main faces and an edge face; and an edge strip mounted at, and extending along, the edge face of the base plate, the edge strip having a strip longitudinal direction and including a strip body and a lighting assembly held on the strip body, the strip body covering the edge face;

wherein the lighting assembly includes an elongate hollow body, a circuit board and a plurality of light source elements mounted on the circuit board;

wherein the hollow body is separate from the strip body and is made of a transparent material;

wherein the hollow body has an outer surface which is closed on all sides when viewed in a section orthogonal to the strip longitudinal direction;

wherein the hollow body has a cavity, and the circuit board is inserted into the cavity;

wherein the strip body forms a light reflection surface which is arranged in the propagation path of the light of the plurality of light source elements and has a diffuse reflecting effect for at least a portion of the light that is incident thereon;

wherein a lens element having a collecting function is formed by the hollow body, the lens element being provided in the propagation path of the light of the plurality of light source elements in front of the light reflection surface; and wherein a main beam axis of each of the plurality of light source elements is directed away from the edge face of the base plate at a right angle to the strip longitudinal direction of the edge strip, when one of the main faces of the base plate is seen in a plan view, and extends at an acute angle to the plate plane of the base plate.

* * * * *